US005538439A

United States Patent [19]

Fell et al.

[11] Patent Number: 5,538,439

[45] Date of Patent: Jul. 23, 1996

[54] ENGINE BLOCK HEATER AND ELECTRICAL CONNECTOR THERETO

[75] Inventors: Michael Fell; Mark Lloyd; Gary Edwards, all of Manitoba, Canada

[73] Assignee: Temro Division, Budd Canada Inc., Winnipeg, Canada

[21] Appl. No.: 246,612

[22] Filed: May 20, 1994

[51] Int. Cl.[6] ..... H01R 13/627

[52] U.S. Cl. ..... 439/357; 439/34

[58] Field of Search ..... 439/357, 34, 352

[56] References Cited

U.S. PATENT DOCUMENTS 5,186,644 2/1993 Pawlicki et al. ..... 439/34

*Primary Examiner*—Gary F. Paumen

*Attorney, Agent, or Firm*—Adrian D. Battison; Stanley G. Ade; Murray E. Thrift

[57] ABSTRACT

A combination of an engine block heater and electrical coupling includes the conventional cylindrical insert which slides into a sleeve on the mounting member for the block heater. An additional spring clip member is provided to hold the electrical coupling in place. The spring clip member has a collar surrounding a rib on the connector body and a pair of spring arms extending at right angles to the collar along a sleeve of the coupling to snap behind a rib on the sleeve. The spring clip arms are connected to the collar at an outer edge thereof with a pair of lobes of increased diameter between the spring clip arms for pushing of the collar longitudinally. A central opening of the collar engages over the connector body with a pair of inwardly projecting portions which slide along slots to a groove at the rib on the connector body.

15 Claims, 2 Drawing Sheets

19
24
25
26
22
23
36
37
32
28
31
41
15
40
30
39
29
27
47
48
45
51
49
16
46
53
54
52
50

ENGINE BLOCK HEATER AND ELECTRICAL CONNECTOR THERETO

BACKGROUND OF THE INVENTION

This invention relates to a combination of an engine block heater and an electrical connector thereto.

An engine block heater generally comprises a mounting member engagable with the engine block for mounting therein and a heating element mounted on the mounting member so as to project rearwardly therefrom into the engine block for heating of the engine block. Various different designs and shapes of the mounting member are provided and the heating element similarly can be shaped and arranged in a number of different shapes to accommodate different designs of engine block and to accommodate different amounts of spacing behind the engine block wall for the heating element to project into the water jacket.

In some cases the mounting member includes a male screw thread for threadedly fastening into a female screw thread into the engine block wall. In other cases the mounting member can be held in place by a clamping arrangement actuated by a screw externally of the mounting member.

In addition, of course, it is necessary to provide an electrical connector for supplying electrical power to the heating element. Generally the electrical connector includes a wire and a connector body which engages with a receptacle on the mounting member. Usually the receptacle comprises a sleeve with a base of the sleeve on the mounting member and an open end of the sleeve facing away from the mounting member. Within the sleeve is provided a pair of pins extending axially of the sleeve. The connector body has a generally cylindrical portion which fits into the sleeve with a pair of bores each for receiving a respective one of the pins so that the connector body is a friction fit within the receptacle to hold the connector body in place. In many engine and block heater constructions, this friction fit between the connector body and the receptacle body is sufficient to hold the electrical connector in place and no additional coupling is necessary.

In some more specialized arrangements, however, it is necessary to provide a separate fail safe holding device which engages a suitable element on the connector and holds this against or onto the receptacle. Up till now the most effective way to provide such a holding device is simply to provide a female threaded collar which slides over the electrical connector and engage a radially extending rib on the electrical connector and is threadedly fastened onto a male screw thread on the outside surface of the sleeve. From a mechanical point of view, this arrangement of the threaded collar is entirely satisfactory and has been used for many years.

However it has been determined that it is undesirable to use a threaded collar as the holding device since the threaded collar can be only applied in assembly of the engine and engine block heater by manual operation of the collar in which the worker rotates the collar a requisite number of turns to effect inter engagement of the screw threads. This operation of rotating the collar requires a significant period of time, but more importantly opens the worker to the risk of carpal tunnel syndrome.

In view of this difficulty, it is one object of the present invention, to provide an improved holding device for holding the connector body onto the coupling member which avoids the necessity for repeated rotation of the holding member in engagement of a screw thread arrangement.

SUMMARY OF THE INVENTION

According to one aspect of the invention there is provided a combination of an engine block heater and an electrical connector thereto, the engine block heater comprising a mounting member engageable with the engine block for mounting therein, a heating element mounted on the mounting member so as to project rearwardly therefrom into the engine block for heating of the engine block, an electrical coupling member mounted on the mounting member so as to project outwardly therefrom for connection to electrical connector, coupling member comprising a sleeve surrounding an axis with a base of the sleeve on the mounting member and an open end of the sleeve facing away from the mounting member, a pair of connector pins inside the sleeve extending longitudinally of the sleeve and first rib means on an outside surface of the sleeve projecting radially of the axis, electrical connector comprising an electrical cable having a first wire for connection to one of the pins and a second wire for connection to a second of the pins, a generally cylindrical connector body attached to an end of the cable and having a portion thereof shaped as a sliding fit into the sleeve with two bores therein each for receiving a respective one of the pins, second rib means on the connector body outwardly of the sleeve and extending generally radially of axis, and a spring clip member for holding the connector body onto the coupling member including a collar surrounding the connector body outwardly of the second rib means and having a radially inner edge portion for engaging the second rib means for applying axial force on the second rib means toward the mounting member and a plurality of spring clip arms connected to the collar and extending therefrom longitudinally of the sleeve, each spring clip arm having a hook portion thereof and at end thereof remote from the collar for extending radially inwardly toward said axis and engaging around the first rib means to hold the spring clip member against movement away from the mounting member.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
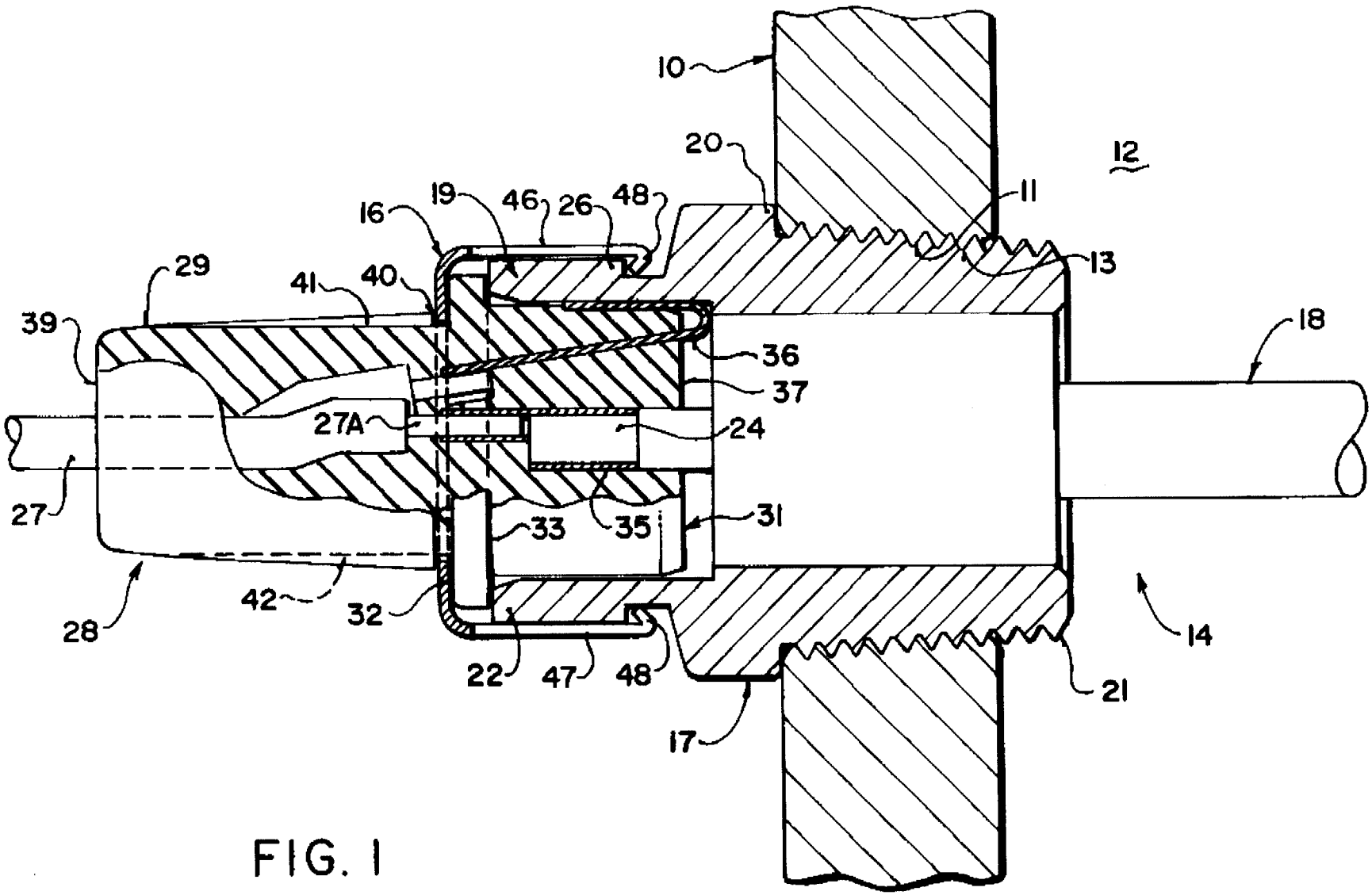
FIG. 1 is a longitudinal cross sectional view through an engine block heater and electrical connector thereto according to the present invention, the cross section being taken along the lines 1—1 of FIG. 2.

The apparatus shown in FIG. 1 comprises an engine block generally indicated at 10, only part of which is shown as the remainder is of course well known to one skilled in the art. The engine block includes an engine block wall with an opening 11 into the interior of a jacket 12 containing a fluid to be heated. In the embodiment shown the opening 11 includes a female screw thread 13 by which the engine block heater is engaged into the engine block in fixed position relative thereto and at the same time providing a seal to prevent escape of the fluid from the jacket 12.

The apparatus further includes the engine block heater itself generally indicated at 14, an electrical connector 15 and a retaining spring clip member 16.

The engine block heater comprises a mounting member 17, a heating element 18 and a receptacle 19 for the electrical connector 15. The mounting member 17 includes a shoulder 20 for engaging an outside surface of the wall of the engine block. The mounting member further includes a cylindrical wall portion 21 which engages into the opening 11 and includes a male screw thread on an outside surface of the cylindrical wall portion 21 for engaging into the female screw thread 13. The heating element 18 is mounted on a rearward side of the mounting member so as to project inwardly into the jacket. For convenience of illustration the electrical connection between the heating element and the receptacle is omitted as this will be well apparent to one skilled in the art.

On a forward facing portion of the mounting member 17 is provided the receptacle 19 which includes a sleeve 22 having a base of the sleeve mounted on the front face of the mounting member 17 and an open end of the sleeve as indicated at 23 in (FIG. 4) facing forwardly from the mounting member. The receptacle further includes a pair of electrical connector pins 24 and 25 mounted within the sleeve and extending axially along the sleeve. On an outside surface of the sleeve is provided a first rib 26. In the embodiment shown, the rib 26 is provided by an end turn of a plurality of turns of a male screw thread around the outside surface of the sleeve 22. The male screw is of the type which would normally in a previous embodiment receive the conventional collar in threaded engagement therewith. However in the present arrangement the male screw thread is not necessary and a rib of a different type can be used comprising for example simply an annular rib surrounding the sleeve and extending radially outwardly therefrom at a predetermined axial location along the length of the sleeve. Thus the present invention can be used either with the existing threaded arrangement or with a specially designed arrangement which simply includes a rib around the sleeve.

Figures 2, 3, 4:
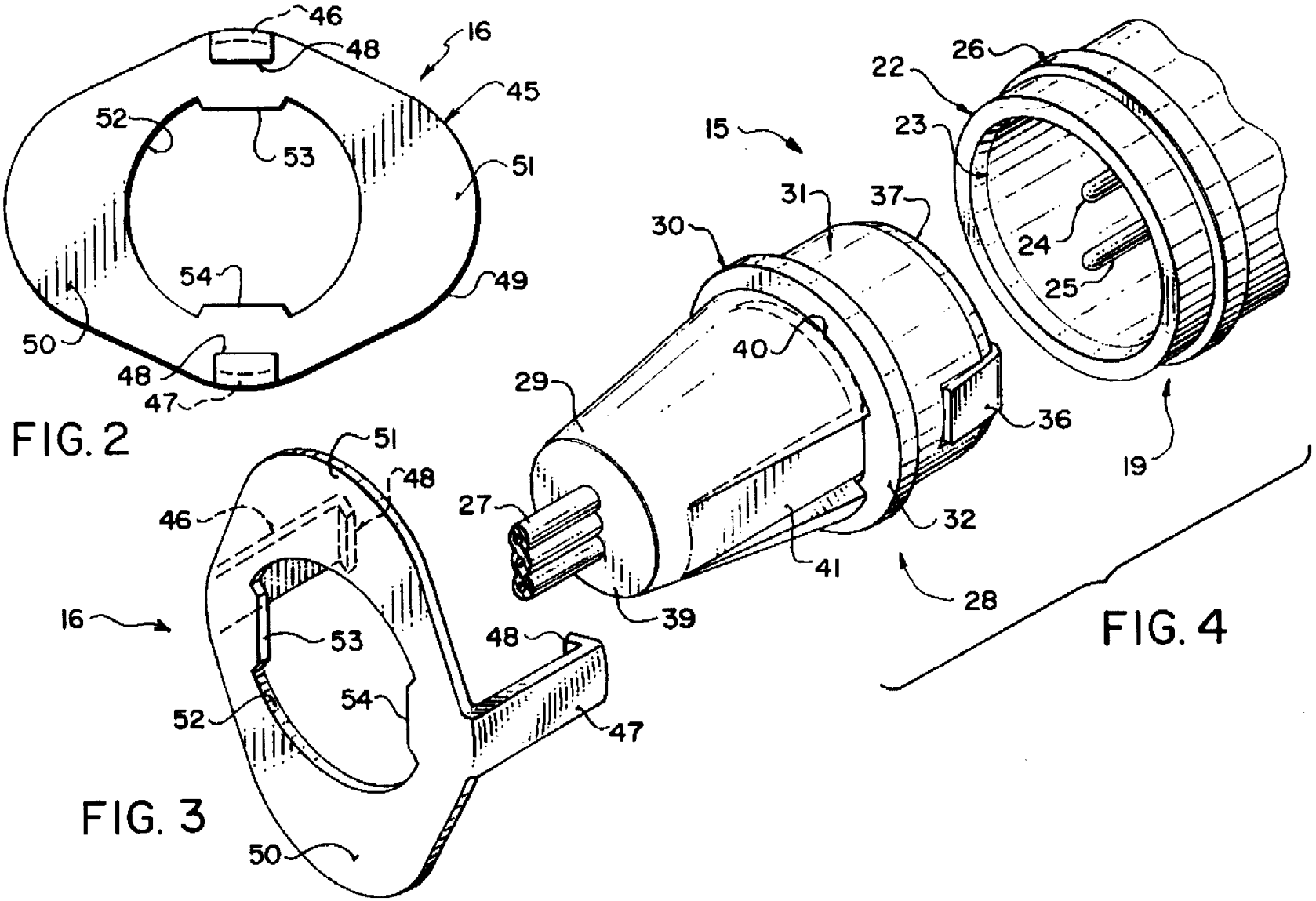
FIG. 2 is a front elevational view of the spring clip member of FIG. 1.
FIG. 3 is an isometric view of the spring clip member of FIG. 1.
FIG. 4 is an isometric view of the electrical connector of FIG. 1.

The electrical connector 15 comprises an electrical wire 27 and a connector body generally indicated at 28. The connector body includes a first portion 29 which is generally frusto conical in shape, a central rib 30 and an insert portion 31 on the opposite side of the rib 30 from the first portion 29. The rib is in the form of annular member surrounding the full periphery of the connector body and the rib includes an outer wall 32 in a first radial plane at an inner wall 33 in a second radial plane. The connector body provides electrical connection between the wire 27 and the receptacle and includes a pair of sleeves 35 each of which receives a respective one of the pins 24, 25 as a friction fit therein. The sleeve comprises a metal sleeve attached to an end of a respective one of the wire portions 27A. The connector body further includes a spring connector 36 acting as a ground connector for connection to a ground wire of the cable which extends through the connector body to an end face 37 of the insert portion 31 and then turns back over the peripheral surface of the insert portion as shown in FIG. 4. In a free position of the device, the spring connector 36 extends slightly outwardly away from the cylindrical surface of the insert portion 31. In the inserted position shown in FIG. 1, the spring connector is pressed flat against the inside surface of the sleeve so as to provide additional frictional engagement between the connector body and the receptacle.

Thus when the connector body is inserted into the receptacle, the spring connector 36 engages the inside surface of the sleeve and each of the pins engages into a respective one of the bores in the end face 37 of the insert portion. The cylindrical surface of the insert portion 31 matches as a sliding fit the inside surface of the sleeve so these elements cooperate in engagement and hold the insert portion within the sleeve. The end wall 33 of the collar engages the end of the sleeve in this position to act as an abutment to stop the insertion.

The portion 29 of the electrical connector is generally frusto conical in shape with an end face 39 through which the wires 27 extend. The outer peripheral surface of the portion 29 thus diverges outwardly toward the end face 32 of the rib 30. Immediately adjacent the end face 32 of the rib 30, there is provided a groove 40 surrounding the portion 29. The depth of the groove 40 is such that the diameter of the base of the groove is slightly greater than the diameter of the portion 29 at the end face 39. A pair of slots 41 and 42 are provided in the peripheral surface of the portion 29 so that the slots have a base surface of a constant diameter equal to that of the base of the groove 40. Thus the depth of the slots 41 and 42 gradually decreases toward the end face 39 of the portion 29.

The spring clip member 16 is formed from metal by a stamping process thus forming an integral metal body including a collar 45 and a pair of spring arms 46 and 47. The spring arms 46 and 47 are connected to the collar at an outside edge of the collar and then are turned in the stamping process so as to extend at right angles to the single plane of the collar 45. Each spring arm 46, 47 includes an inwardly turned hook portion 48 at an end thereof remote from the collar 45. As shown the hook portion 48 is turned inwardly and rearwardly toward the collar so as to provide a hooking action around the rib 26.

The collar 45 lying in the single plane includes the outer edge of the collar indicated at 49, the shape of which is best shown in FIG. 2. This includes a pair of lobes 50 and 51 which are of increased diameter relative to that portion of the edge at which the arms 46 and 47 are connected. The collar further includes an opening 52 which is generally circular but includes a pair of inwardly projecting portions 53 and 54 which extend only over a relatively small portion of the circular periphery of the opening 52.

In assembly of the connector onto the sleeve, the spring clip member can initially be inserted in place on the connector body by engaging the opening 52 over the end face 39 of the portion 29, by aligning the inwardly projecting portions 53 and 54 with the slots 41 and 42 by sliding the portions 53 and 54 longitudinally of the slots until the inside face of the collar engages the surface 32 of the rib 30 and then by rotating the collar around the axis so that the portions 53 and 54 become misaligned to the slots 41 and 42. In this way the portions 53 and 54 lie within the groove 40 and prevent the collar from moving away from the rib 30. The inside surface of the collar is held against the rib 30 and applies axial force thereto.

With the spring clip member thus in place on the connector body, the connector body can be inserted into the sleeve as previously described while the spring clip arms 46 and 47 engage over the rib 26. The slight spring action available from the arms allows the hook portions 48 to move outwardly in sliding over the rib 26 and then to re-engage behind the rib to hold the spring clip member against movement away from the sleeve. Thus the connector body is held in place by the engagement of the collar with the rib 30 and the hook portions 48 with the rib 26. This prevents any possible of release of electrical connector from the coupling on the mounting member due to excessive vibration of the engine or even due to inadvertent pulling of the cord.

The lobes 50 and 51 allow the user to simply push the collar over the portion 29 using finger pressure against the lobes with sufficient space on the lobs for receiving the thumb and forefinger in a pushing action.

In an alternative assembly technique, the spring clip member is removed from the connector body and is placed at a position along the length of the wire where it is readily accessible. The connector body is then inserted into the coupling onto the mounting member as the friction fit following which the spring clip member is brought into place. After the connector body is inserted into the coupling, the spring clip member is brought into place and slides along the portion 29 as previously described while simultaneously the spring clip arms are engaged over the rib 26. This technique reduces the amount of force necessary to push the whole device in place since the pushing is effected in two separate steps. If required, the spring clip member can then be rotated to again misalign the portions 53, 54 and the associated slots 41, 42.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A combination of an engine block heater and an electrical connector thereto, the engine block heater comprising a mounting member engageable with the engine block for mounting therein, a heating element mounted on the mounting member so as to project rearwardly therefrom into the engine block for heating of the engine block, an electrical coupling member mounted on the mounting member so as to project outwardly therefrom for connection to said electrical connector, said coupling member comprising a sleeve surrounding an axis with a base of the sleeve on the mounting member and an open end of the sleeve facing away from the mounting member, a pair of connector pins inside the sleeve extending longitudinally of the sleeve and first rib means on an outside surface of the sleeve projecting radially of the axis, said electrical connector comprising an electrical cable having a first wire for connection to one of the pins and a second wire for connection to a second of the pins, a generally cylindrical connector body attached to an end of the cable and having a portion thereof shaped as a sliding fit into the sleeve with two bores therein each for receiving a respective one of the pins, second rib means on the connector body outwardly of the sleeve and extending generally radially of said axis, and a spring clip member for holding the connector body onto the coupling member including a collar surrounding the connector body outwardly of the second rib means and having a radially inner edge portion for engaging the second rib means for applying axial force on the second rib means toward the mounting member and a plurality of spring clip arms connected to the collar and extending therefrom longitudinally of the sleeve, each spring clip arm having a hook portion thereof and at end thereof remote from the collar for extending radially inwardly toward said axis and engaging around the first rib means to hold the spring clip member against movement away from the mounting member.

2. The combination according to claim 1 wherein the spring clip member includes two of said spring clip arms arranged at diametrically opposed positions relative to the axis.

3. The combination according to claim 1 wherein the spring clip arms are connected to the collar at an outer edge of the collar.

4. The combination according to claim 1 wherein the spring clip member is formed integrally from metal.

5. The combination according to claim 4 wherein the spring clip member includes two of said spring clip arms arranged at diametrically opposed positions relative to the axis.

6. The combination according to claim 4 wherein the spring clip arms are connected to the collar at an outer edge of the collar.

7. The combination according to claim 2 wherein the collar is substantially planar lying in a plane radial to the axis and wherein an outer edge of the collar at a location on the collar intermediate the spring clip arms is spaced radially outwardly from the axis by a distance greater than the spring clip arms.

8. The combination according to claim 3 wherein the collar is substantially planar lying in a plane radial to the axis and wherein an outer edge of the collar at a location on the collar intermediate to the spring clip arms is spaced radially outwardly from the axis by a distance greater than the spring clip arms.

9. The combination according to claim 4 wherein the collar is substantially planar lying in a plane radial to the axis and wherein an outer edge of the collar at a location on the collar intermediate to the spring clip arms is spaced radially outwardly from the axis by a distance greater than the spring clip arms.

10. The combination according to claim 1 wherein the connector body includes a groove thereon lying in a plane radial to the axis at a position thereon immediately adjacent the second rib means, the groove being arranged to receive therein the collar to hold the collar against axial movement relative to the connector body.

11. The combination according to claim 10 wherein the connector body includes an axial slot thereon communicating with the groove, the collar having a radially inwardly projecting portion thereof for engaging into the groove, the radially inwardly projecting portion being slidable axially along the slot to allow release of the collar from the groove.

12. The combination according to claim 11 wherein the connector body includes two opposed slots and wherein the collar includes two opposed radially inwardly projecting portions each slidable along a respective one of the slots.

13. The combination according to claim 12 wherein the spring clip member includes two spring clip arms, each arranged at a position angularly aligned with a respective one of the radially inwardly projecting portions.

14. The combination according to claim 13 wherein the collar is substantially planar lying in a plane radial to the axis and wherein an outer edge of the collar at a location on the collar intermediate the spring clip arms is spaced radially outwardly from the axis by a distance greater than the spring clip arms.

15. The combination according to claim 1 wherein the first rib means comprises an end turn of a male screw thread formed on an outer surface of the sleeve.

* * * * *